United States Patent [19]

Gingher, Jr.

[11] 4,400,877

[45] Aug. 30, 1983

[54] THREAD NIP

[75] Inventor: Clair H. Gingher, Jr., Greensboro, N.C.

[73] Assignee: Gingher, Inc., Greensboro, N.C.

[21] Appl. No.: 338,431

[22] Filed: Jan. 11, 1982

[51] Int. Cl.[3] ..... B26B 13/16

[52] U.S. Cl. ..... 30/253; 30/151

[58] Field of Search ..... 30/253, 151

[56] References Cited

U.S. PATENT DOCUMENTS

| | | | |
|---|---|---|---|
| 238,023 | 2/1881 | Bramberg | 30/151 X |
| 1,409,978 | 3/1922 | Smith | 30/151 X |
| 2,142,738 | 1/1939 | Wakeley | 30/253 |
| 2,524,653 | 10/1950 | Dalley | 30/253 X |
| 3,453,651 | 7/1969 | Wertepny | 30/253 |
| 3,548,496 | 12/1970 | Van Hook | 30/253 |
| 3,608,196 | 9/1971 | Wiss | 30/253 |
| 4,089,113 | 5/1978 | Moritz | 30/253 |

*Primary Examiner*—Jimmy C. Peters

[57] ABSTRACT

A thread nip having a removable sheath and cooperating handles which are pivotably connected through a pivot assembly for yieldably retaining the thread nip handles to support sharpened blades on said handles in cutting relationship with the handles being normally biased in an open mode for cutting against resilient members interacting in said handles between open and closed modes.

7 Claims, 6 Drawing Figures

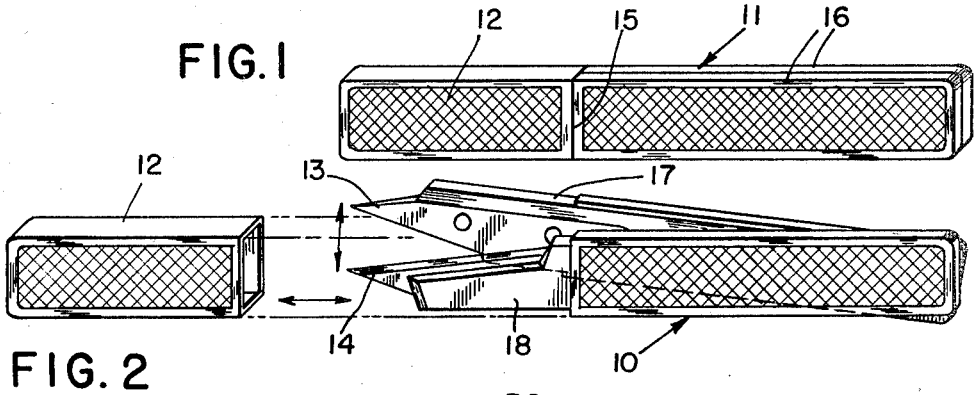
FIG. 1
FIG. 2
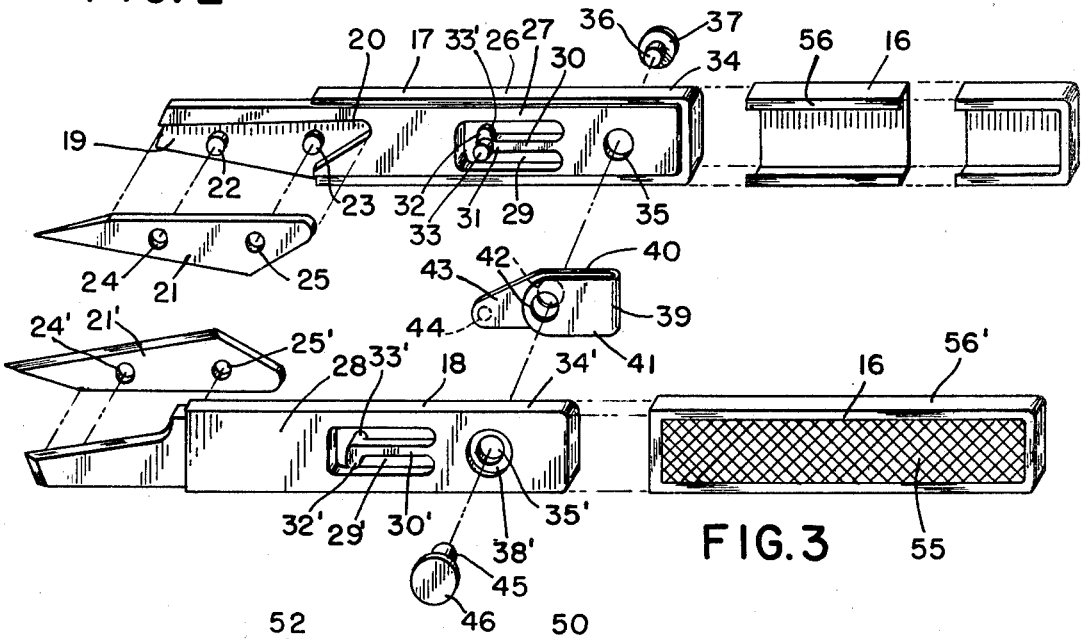
FIG. 3
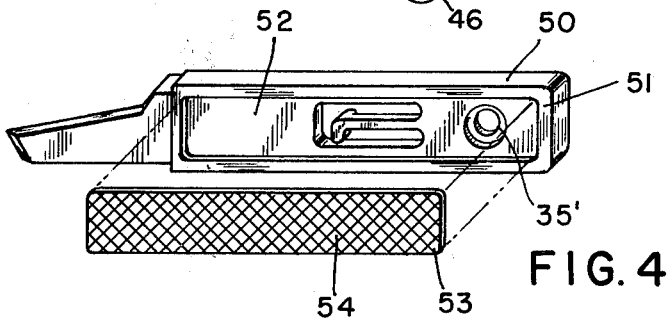
FIG. 4
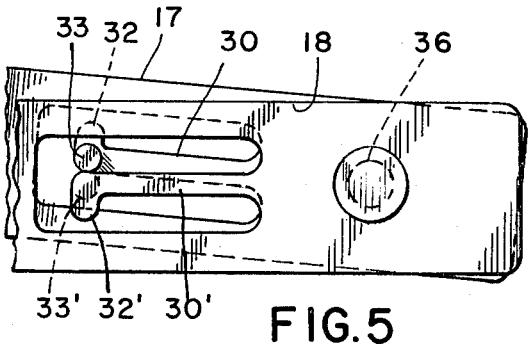
FIG. 5
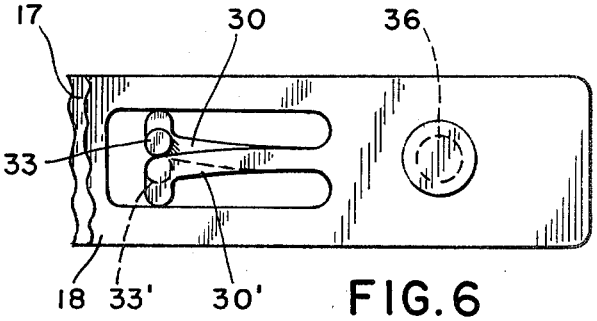
FIG. 6

THREAD NIP

BACKGROUND AND OBJECTIVES OF PRESENT INVENTION

A thread nip or thread snip is widely used in the preparation of textile fabrics and yarns and has many diversified applications in areas other than for textiles. A thread snip is and has become a highly useful tool having a multiplicity of purposes in home, office, shop and industry. Usually, thread snips are fabricated of steel and are relatively heavy depending upon the nature of the type cutting that must be performed. Periodic blade sharpening may be required depending upon the frequency of use and the materials severed. Occasional spring adjustment and pivot assembly repairs are necessary. Frequently, thread snips are discarded rather than repaired despite the relatively small expense in making adjustments and sharpening blades.

It is an objective of the present invention to provide a compact, lightweight, and durable thread nip which may be readily available for use as a cutting implement for innumerable tasks whether for seamstresses, industrial, office, or home utilization.

Another objective of this invention is the provision of a thread snip that may be conveniently carried in the purse or pocket because of its lightweight, compactness, and protective features, comparable to a writing instrument such as a pen or a pencil.

Other objects and many of the attendant advantages of this novel thread snip will become more readily apparent from the following detailed description of a preferred embodiment, a brief summary of the invention, and a brief description of a drawing of the preferred embodiment with the recognition that variations may be made in the materials and positioning of the components which variations are contemplated within the scope of the appended claims.

SUMMARY OF THE INVENTION

A thread nip in which a pair of identical glass-reinforced plastic blade-retaining handles is pivotably held together adjacent one end of the handles by means of a pivot spring assembly and pin member. A pair of sharpened steel blade members is secured to blade-receiving recesses in a blade-receiving portion of the thread nip for cooperative cutting engagement. Each blade-retaining handle is molded and provided with an intermediate portion having an opening therein into which an axially-extending cantilever spring-biasing member is integrally formed in the handle. The free end of the axially-extending cantilever spring member is provided with a transversely-extending boss or lug. An offset lug member is integrally molded to the transverse member for biasing or urging said handles to pivot about the pivot assembly means in the open mode for cutting. Upon urging the handles in overlapping relationship or in the closed mode, the spring members are biased or stressed within their handle openings urging the handles to the open mode. A handle-enclosing sleeve member envelops a substantial portion of each handle without interfering with the pivotal displacement of each handle or interferring with the action of the cutting blades. A single open-ended sheath slides cooperatively over the cutting blades, in the thread nip closed mode for encapsulating the thread nip and retaining the nip in the closed mode against the biasing action of the spring members.

BRIEF DESCRIPTION OF DRAWING

FIG. 1 is a side perspective view of an encapsulated thread nip embodying the invention;

FIG. 2 is a side perspective view of the thread nip in the open mode with a blade encapsulating sheath displaced laterally and the cutting blades in operative position with the handles pivoted apart in the open mode;

FIG. 3 is an exploded perspective view of the thread nip illustrating the various components in displaced relative positions, the spring biasing members in their unbiased condition, and with one of the handle cover members having an intermediate portion removed therefrom;

FIG. 4 is an exploded perspective view of a modified blade handle and cover plate;

FIG. 5 is an enlarged partial schematic view of a pair of handles pivoted to the open mode; and FIG. 6 is similar to FIG. 5 with the handles pivoted to the closed mode illustrating the blade spring levers in a biased or stressed position.

DETAILED DESCRIPTION OF PREFERRED EMBODIMENT OF THE INVENTION

Referring to the drawing and particularly to FIGS. 1 and 2, there is illustrated a thread nip or snips 10 in the open or operative cutting mode in FIG. 2, and in the closed sheathed mode 11 in FIG. 1. The closed thread nip 11, in FIG. 1, is provided with a removable open-ended plastic sheath or sleeve member 12 which has a rectangular cross-section for cooperative and releasable retention over the pointed ends 13 and 14 of the sharpened cutting blades 21 and 12' for abutment with the forward or leading edge 15 on the end of the nip handle covers 16. In the closed sheath mode 11 of FIG. 1, the thread nip is slender and compact and sufficiently flat to be safely and readily pocketed either in a purse or pocket.

Each of the blade-retaining handles 17 and 18 as shown in FIG. 3, is identical in configuration and construction having been molded preferably of glass-reinforced nylon to insure strength, lightness and durability. Since each blade-retaining handle 17 and 18 is identical, a detailed description of one handle will suffice for both except to indicate that one is inverted relative to the other in the assembled condition as will be readily apparent in FIG. 3, and the components or portions of one will be designated its reference character and the corresponding component or portion on the other handle will be designated with the same reference character modified by a prime (').

Handle 17 has a blade-receiving flat base indentation 19 with a converging rear recess 20 for seating a sharpened cutting edge and pointed steel blade 21 into the recess 20 for securement by means of the spaced blade-retaining lugs 22 and 23 which are integrally molded preferably in the flat base blade-receiving indentation 19 for cooperatively receiving the blade openings 24 and 25, respectively, thereon. The projecting blade-receiving lugs 22 and 23, with the blade 21 mounted thereon, may be stamped or heated to retain the blade 21 securely on the forward blade section of the handle 17.

The intermediate section 26 of the handle 17 is substantially rectangular in cross-section, and is provided with a flat recessed side 27 and a flat planar opposite side 28 as illustrated on handle 18. The intermediate section 26 has a rectangular opening or window 29 in which opening an axially-projecting integral spring lever 30 is supported in cantilever form in the base of handle 17. An eccentrically extending boss 32 is integrally molded to the free end 31 of lever 30. The boss 32 is provided with an outwardly extending integral limit lug 33 for cooperative engagement with a corresponding integral limit lug 33' on the other handle 18, the operation of which will be described more fully hereafter.

The rear pivot section 34 of handle 17 has a pivot pin-receiving opening 35 therethrough for cooperatively receiving the stud portion 36 of the headed pivot member 37. A concentric recess (not shown) in handle 17 is provided around the opening 35 comparable to the concentric recess 38' surrounding the pin-receiving opening 35' in the handle 18.

A return bend spring member 39 which has spaced-apart parallel leaves 40 and 41 with aligned stud-receiving openings 42 is positioned between blade handles and retained by the stud portion 36 of the pivot member 37. Spring member 39 is provided with an extension 43 on leaf 40 on which a limit stop 44 is mounted for insertion into the opening or window 29 to control displacement of spring member 39 when positioned between the mating handles 17 and 18. The female sleeve 45 on the cap member 46 will cooperatively retan the stud portion 37 in the thread nip assembled condition with the cap member 46 being positioned within the recess 38' in the handle 18.

As shown in FIGS. 5 and 6, the handles 17 and 18 are pivoted into the open mode about the pivot stud 36 with each of the levers 30 and 30' being shown, in FIG. 5, in their unbiased or unstressed condition, as also shown in FIG. 3. The projecting limit lugs 33 and 33', however, contact each other tangentially. In the closed mode, shown in FIG. 6, the levers 30 and 30' are stressed sufficiently to be arcuate forming, with the resilient levers 30 and 31, a spring action so that the lugs 33 and 33' will continue to contact each other while being subjected to the biasing or spring action of levers 30 and 30' to urge the blades 17 and 18 to pivot and separate into the open mode as shown in FIGS. 2 and 5 from the closed mode shown in FIGS. 1 and 6.

The sheath 12 is positioned by sliding it over the pointed ends 13 and 14 of the blades 21 and 21' to retain the handles 17 and 18 in the overlapped handle closed mode as shown in FIGS. 1 and 6. Upon removal of the sheath 12, the biasing or spring action of levers 30 and 30' will urge the blades 17 and 18 to pivot outwardly into the open mode as shown in FIGS. 2 and 5. Alternating finger pressure on the handles 17 and 18 adjacent to the blades 21 and 21' will produce the desired opening and closing or pivoting of the handles for the cutting action by the blades.

There is illustrated in FIG. 4, a modified handle 50 which has a raised perimeter 51 and recessed rectangular base 52 for cooperatively receiving the cover or handle plate 53 for a flush mounted position. Plate 53 may be securely fastened within the recess 52 so that it may be flush with the perimetrical rim 51. The exterior surface 54 of plate 53 may be knurled, scored or textured similar to the surface texture of sheath 12 and the handle covers 16.

The handle covers 16 are preferably slidably mounted on the handles 17 and 18 and may be frictionally or adhesively secured to the handles. Each of the handle covers 16 is provided with a substantially flat surface 55 and a projecting perimetrical flange 56 for suitably encasing or enclosing the handles 17 or 18.

Sheath 12 is retained by friction on the handles 17 and 18 covering the blades 21 and 21' with the biasing action of the spring levers 30 and 31' serving to hold the sheath 12 releasably in position as illustrated in FIG. 1. By slidably removing the sheath 12 off the handles 17 and 18 and blades 21 and 21', the thread nip will spring into the open mode ready for cutting action.

I claim:

1. A thread nip comprising; a pair of blade-retaining handles positioned against each other, each said handle having a blade-receiving portion, an intermediate portion having an opening therein and a spring biasing member extending into said opening, and a rear pivot portion having a pivot pin-receiving opening therein, a pivot assembly means pivotally joining said handles together retained in said pivot pin-receiving opening, said spring biasing member cooperatively aligned to urge said handles to pivot about said pivot assembly means in an open mode and to bias said blades to separate in a closed mode, and a blade mounted on each of said blade-receiving portions for cooperative cutting engagement from the open to the closed mode.

2. A thread nip as claimed in claim 1, a blade handle cover retained by said blade handle covering said intermediate and rear pivot portions.

3. A thread nip as claimed in claim 2, and a sleeve member having an open end for slidably covering said blade-receiving portion and blades for retaining the thread nip in a closed mode against the biasing action of said spring biasing members.

4. A thread nip as claimed in claim 1, a return bend spring having a lug thereon positioned between said handles at the rear pivot portion and retained on said pivot assembly, and said lug-engaging said opening in said intermediate portion.

5. A thread nip as claimed in claim 1, each said blade being fabricated of steel and having means for securement to said blade-receiving portions, and each said blade having a sharpened exposed cutting edge.

6. A thread nip as claimed in claim 1, said spring biasing member on each handle having a lever integrally formed thereon and extending axially in said opening in cantilever form, said lever having a freely extending terminal laterally displaceable end, said displaceable end having an offset projecting limit lug thereon whereby in the closed thread nip closed mode, said lever on each handle urges said handles to pivot outwardly from a closed to an open mode.

7. A thread nip as claimed in claim 1, said spring biasing member on each handle being integrally formed thereon and projecting axially in cantilever form in said opening, said biasing member having a freely extending terminal and laterally displaceable end, said displaceable end having an offset projecting limit lug thereon whereby, in the closed thread nip mode, each said spring biasing member flexes pressing said limit lugs in contact with each other and urge said handles to pivot outwardly to the open mode, each said spring biasing member extends axially in said opening and said limit lugs on each said member engages each other in the intermediate adjacent portion of the pivotable handles.

* * * * *